United States Patent [19]

Dominguez et al.

[11] Patent Number: 5,024,567

[45] Date of Patent: Jun. 18, 1991

[54] CENTER BEAM/CENTER PARTITION FLAT CAR AND RETENTION ASSEMBLY

[76] Inventors: Danilo A. Dominguez, 1867 Piedras Cir., Danville, Calif. 94526; James F. Flores, 4 Overhill Rd., Mill Valley, Calif. 94941

[21] Appl. No.: 422,746

[22] Filed: Oct. 17, 1989

[51] Int. Cl.[5] ..... B61D 45/00

[52] U.S. Cl. ..... 410/100; 410/98; 410/97; 410/32

[58] Field of Search ..... 410/32, 96, 97, 98, 410/100, 101, 103, 115, 94, 102, 106, 108, 109, 110; 105/355, 370, 371, 404, 416, 417, 418, 419

[56] References Cited

U.S. PATENT DOCUMENTS

| | | | |
|---|---|---|---|
| 3,043,550 | 7/1962 | Garbarino | 410/110 |
| 3,173,645 | 3/1965 | Gray | 410/99 |
| 3,678,866 | 7/1972 | O'Leary | 410/100 |
| 3,734,031 | 5/1973 | Wagner | 105/404 X |
| 4,060,036 | 11/1977 | Palms | 410/102 X |
| 4,102,274 | 7/1978 | Feary | 410/102 X |
| 4,382,736 | 5/1983 | Thomas | 410/103 X |
| 4,543,887 | 10/1985 | Baker | 105/416 X |
| 4,630,982 | 12/1986 | Fenner | 410/102 |
| 4,753,175 | 6/1988 | Harris | 105/355 |
| 4,784,067 | 11/1988 | Harris et al. | 105/416 X |

*Primary Examiner*—Frank E. Werner
*Assistant Examiner*—Craig Slavin
*Attorney, Agent, or Firm*—Edward D. Gilhooly

[57] ABSTRACT

A center beam/center partition flat car, cable/strap retention assembly and method for retaining a load to a center beam/center partition flat car. Cables or straps are respectively retained to a plurality of winches positioned along the opposite side sills of the flat cars. The cables or straps extend around the load from bottom to top and downward with their free ends being secured to the floor deck of the flat car at a position adjacent the respective winches.

12 Claims, 3 Drawing Sheets

CENTER BEAM/CENTER PARTITION FLAT CAR AND RETENTION ASSEMBLY

BACKGROUND OF THE INVENTION

1. Field of Invention

This invention relates in general to railway cars and more particularly, to an improved cable/strap assembly for center beam flat cars used to tie down loads.

2. Description of the Prior Art

At present, lumber and other construction material is conventionally transported by railroads in center beam/center partition railcars. The center beam/center partition design permits the construction of lightweight cars with long spans between the bulkheads at each end. Generally, the center beam/center partition flat car includes a center beam assembly having a plurality of truss vertical columns situated along the longitudinal center sill. The upper ends of the truss vertical columns are coupled to an upper beam structure that extends between the bulkheads. Lumber or other lading is carried on the floor deck on opposite sides of the truss vertical columns. The lumber and the like that is transported in center beam/center partition flat cars is commonly made up of equal length pieces banded together in modules. The lengths of the modules range from eight to thirty-two feet in increments of two foot lengths and nominal four foot widths. The actual width of lumber modules varies according to nominal dimensions of 2"×4", 2"×6", 2"×8", 2"×10", and 2"×12". The height of each module is a constant twenty-four inches. The modules of lumber can be stacked up to five high on both sides of the center beam/center partition cars.

The modules or other load are presently retained in position on the flat car by an assembly that includes a plurality of elongated cables, straps or chains which extend from winches mounted on the side sills on each side upward along the outer side of the load at a number of longitudinal positions. The upper free ends of the elongated retention members are secured above the load in keyslots or other retention means provided on the upper beam assembly of the center beam/center partition flat car. The cables and the like thereby primarily secure the outer lateral wall and top of the load on the flat car during transport.

Several problems are associated with the attachment of the ends of the elongated members at positions above the load as in the known technique of securement. The necessity of attachment of the free end of the cable or strap above the modules after loading, or alternatively to release the secured free end for unloading, is inconvenient and time consuming. The normal procedure is for personnel to climb the flat car after loading and attach the free ends of the cable or strap to keyslots provided in the upper beam assembly. The tension on each of the elongated members is thereafter tightened by the winches from ground level after the free ends are retained. Similarly, unloading requires release of the free ends of the cable or strap, again requiring personnel to climb the center beam/center partition car. It should be apparent that the winches are not positioned at an efficient location relative to the keyslots or other securement means in known arrangements. In addition, the secured cable or strap in the prior art only overlaps a portion of the load along the outward face and across the top without achieving optimum confinement. One or more of the cables or straps in the prior art designs are also frequently left dangling from the winches beyond the side of the car, after the free end is released, particularly after unloading. The presence of unrestrained straps, cables, or chains hanging from the flat car presents a potential safety hazard and damage to the individual elongated retention members. Therefore, it is desirable to provide an improved strap/cable assembly for center beam/center partition flat cars that eliminates the foregoing problems.

SUMMARY OF THE INVENTION

It is therefore an objective of the invention to provide an improved cable/strap assembly retaining lumber or other load, such in a module form, on a center beam/center partition flat car during transport. The invention of the application employs a cable/strap assembly in which the free ends of the cables or straps are secured to the flat car in proximity to the winches along the side sill on each side. Such an arrangement eliminates the need of personnel to climb the loaded car to secure or release the cable/strap on the upper beam assembly as in present techniques. The assembly of the application thereby offers greater safety and convenience for a person loading and unloading a flat car and reduces the time required for loading or unloading. Moreover, the invention also eliminates the undesirable presence of dangling unsecured cables or straps as frequently occurs in the present techniques. The cable/strap assembly herein disclosed further surrounds a greater portion of the load than previous strap/cable arrangements for enhanced load retention.

DESCRIPTION OF A PREFERRED EMBODIMENT

Figure 1:
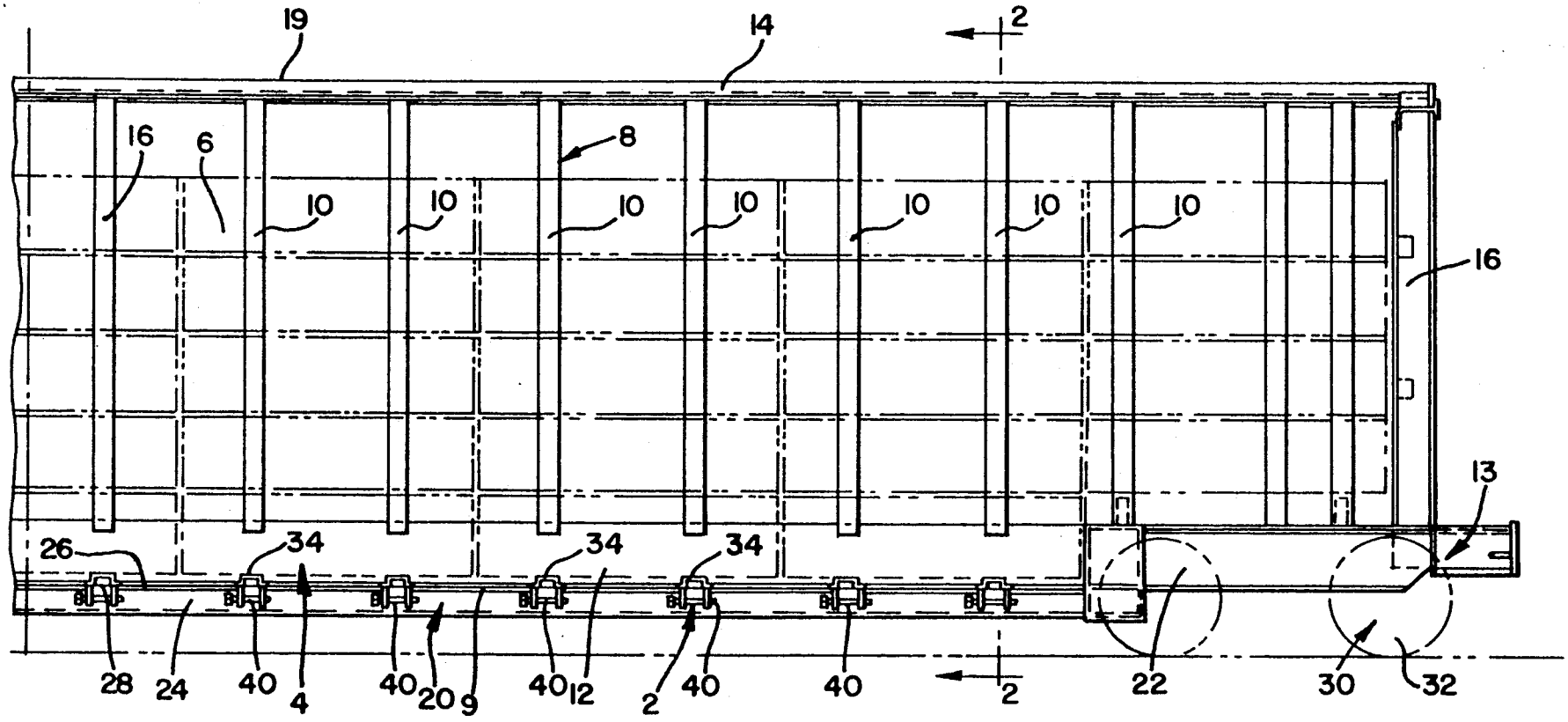
FIG. 1 is a partial side elevational view of a center beam/center partition flat car employing the cable/strap assembly of the invention.
Figure 2:
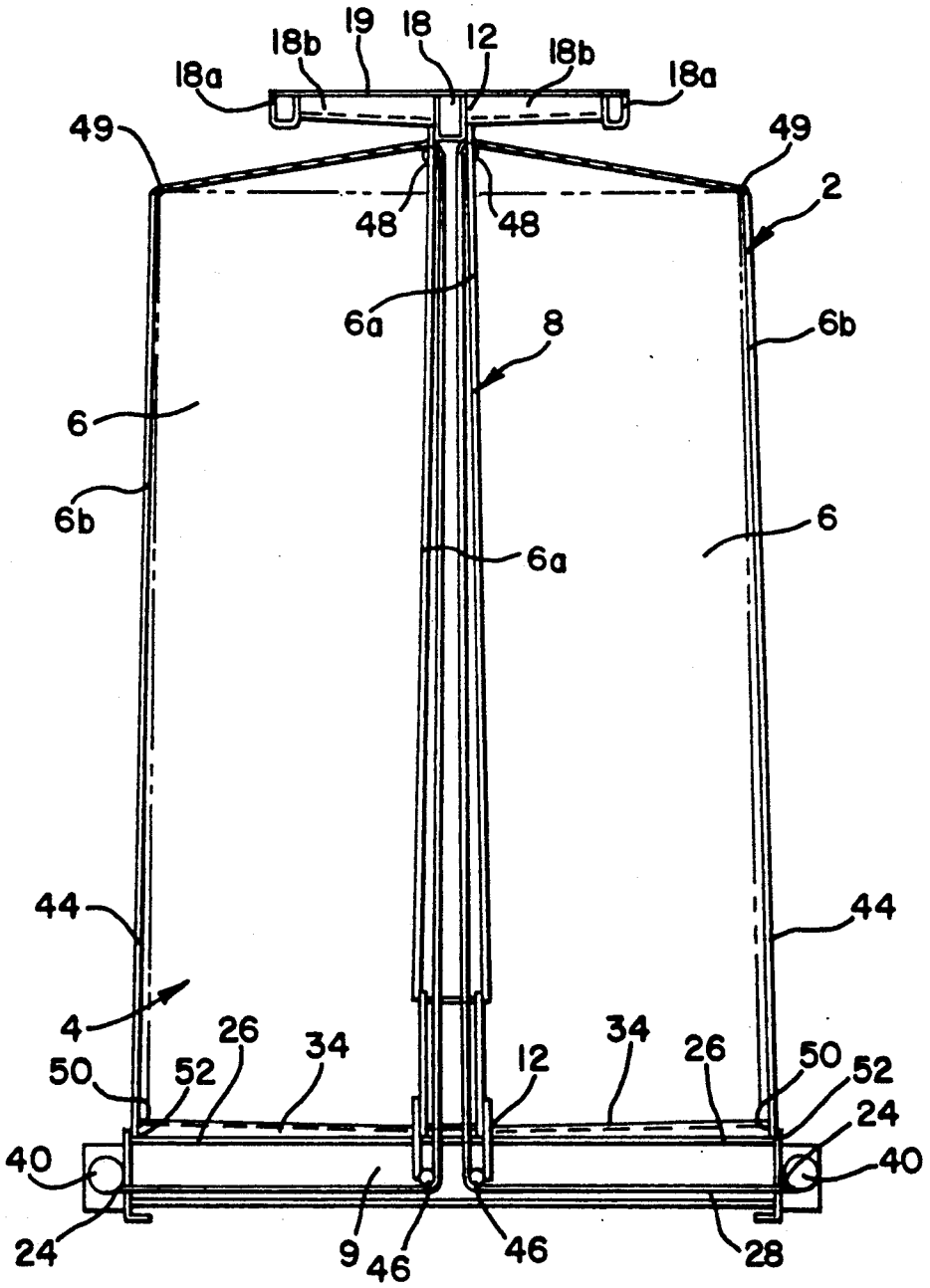
FIG. 2 is an end elevational view, with parts in section, of the flat car of FIG. 1.

Referring to FIGS. 1 and 2, there is illustrated the improved cable/strap assembly of the invention, generally designated by reference numeral 2, shown mounted on a center beam/center partition flat railway car 4. Although flat car 4 is shown with a particular design that is more fully described in our copending application, Ser. No. 363,575 issued Aug. 28, 1990, the cable/strap assembly 2 may be employed with any other design of center beam/center partition flat cars conventionally used to transport lumber and similar loads. As is well known, a load 6 of lumber and the like is stacked as modules on opposite sides of a center beam assembly 8 forming a part of the body 9 of the flat car 4. The center beam assembly 8 includes a plurality of truss vertical columns 10 positioned along the longitudinal center sill 12 extending along the longitudinal centerline of flat car 4. A pair of conventional draft sills 13 are mounted on opposite ends of center sill 12. An upper beam assembly 14 is carried on the upper ends of truss columns 10 and extends between conventional bulkheads 16 (one of which is shown in FIG. 1) that are vertically oriented at each end of flat car 4. The upper beam assembly 14 includes an upper longitudinally extending center sill 18, a pair of parallel upper side sills 18*a*, and a plurality of center beam cross ties 18*b* (FIG. 2). A center beam cover plate 19 is attached above the upper center sill 18, the pair of upper side sills 18*a*, and the plurality of center beam cross ties 18*b*.

The body 9 of flat car 4 further includes a pair of opposed side sill assemblies 20 disposed on opposite sides of center sill 12 in parallel relationship. Each side sill assembly 20 comprises a pair of end sections 22 (one of which is shown in FIG. 1) and an intermediate side sill section 24 which is depressed below the longitudinal axis of end sections 22 to support a depressed lower floor deck 26. A plurality of cross bearer members 28 extend in attached relationship between the opposed intermediate side sill sections 24 and are suitably supported by center sill 12. The cable/strap assembly 2 of the invention may also be employed with other conventional center beam/center partition cars (not shown) that have a load carrying floor deck carried on a continuous side sill extending along a common longitudinal axis on each side. The body 9 of flat car 4 is carried by end truck assemblies 30 (one of which is shown in FIG. 1) of conventional design having wheels 32. The depressed load carrying floor deck 26 is supported by cross bearer members 28 and is provided with a plurality of lateral upper angle members 34 that extend between the center beam assembly 8 and a respective side sill assembly 20. The load 6, in the form of lumber and the like and generally arranged as modules, is carried on the inwardly sloped upper surfaces of the angle members 34 in a manner well known in the art. The modules of load 6 are placed on each side of the center beam assembly 8 with an interior face 6*a* confronting the vertical truss columns 10 and an outer side face 6*b* on both outer sides (FIG. 2).

Figure 4:
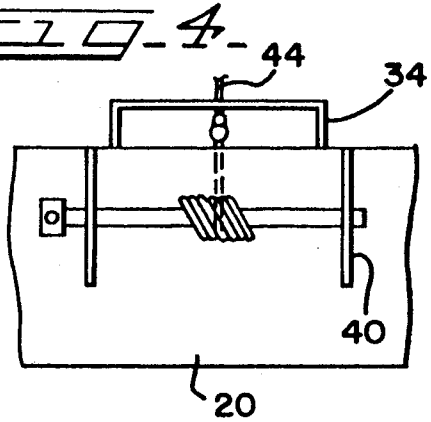
FIG. 4 is a partial side elevational view, with parts removed, of the winch and retention of the free end of the cable/strap assembly of FIG. 1.
Figure 3:
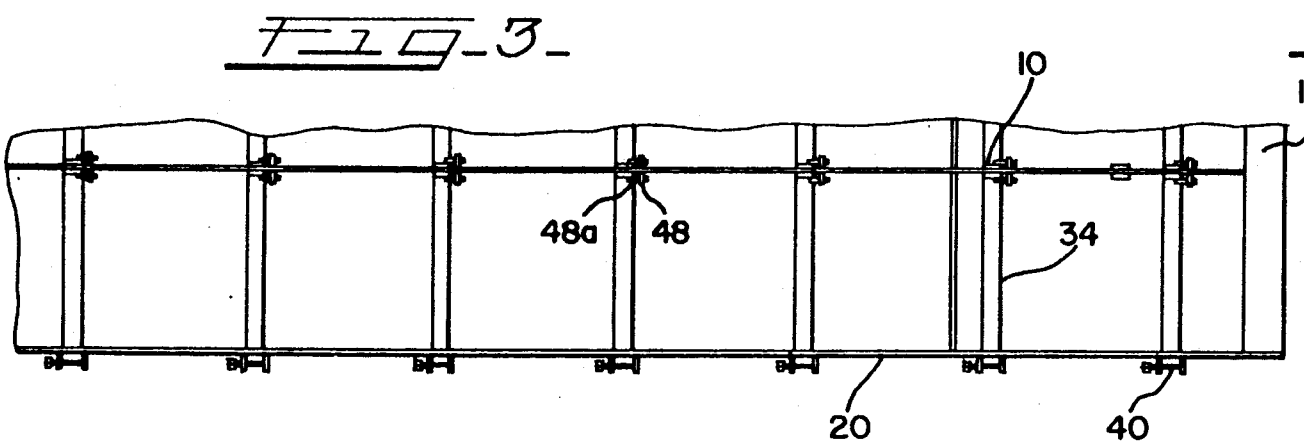
FIG. 3 is a partial top plan view, with parts removed, of the upper pulleys on opposite sides of the flat car of the cable/strap assembly of FIG. 1.
Figure 8:
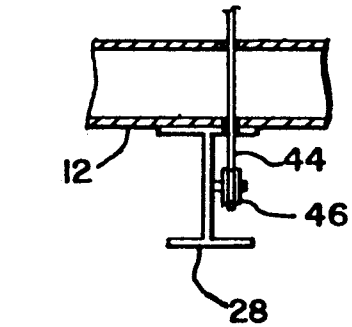
FIG. 8 is a partial side elevational view, with parts in section, of the lower pully of the cable/strap assembly of FIG. 1.
Figure 7:
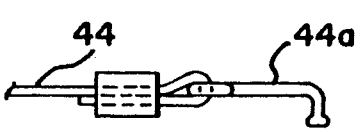
FIG. 7 is a partial end elevational view of the cable/strap assembly of FIG. 1.
Figure 6:
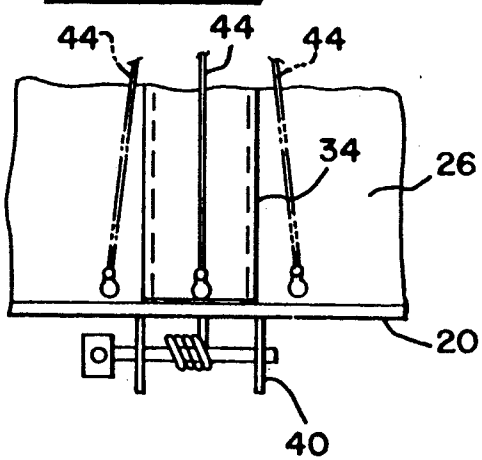
FIG. 6 is a partial top plan view of the retention of the free end of the cable/strap assembly of FIG. 1.
Figure 5:
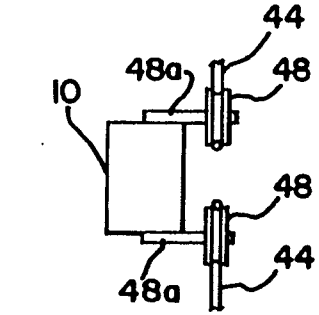
FIG. 5 is a partial top plan view of a truss column supporting opposed upper pulleys of the cable/strap assembly of FIG. 1.

A plurality of cable/strap winches 40 are mounted at a spaced locations along the side sill assemblies 20 on each side of flat car 4. The winches 40 are known design to secure the lower end portion 42 of a respective conventional elongated cable, strap, or chain 44 of a suitable material which are utilized to retain the modules of lumber and the like in place during transport. The winches 40 are used to adjustably tighten or release the tension on cables or straps 44 in a well known manner. The cable or strap 44 extends inward below the floor deck 26 under load 6 and around a lower retention member, such as a pulley 46, suitably retained on the cross bearer members 28 below the load 6 adjacent center sill 12 as illustrated in FIG. 8. The strap or cable 44 is directed upward in a generaly parallel relation to the interior face 6*a* of load 6 and around an upper retention member, such as a pulley 48, attached to flat car 4, such to a truss vertical column 10 by an affixed plate 48*a* as shown in FIG. 5. The cable or strap 44 then extends over the top of the load around a corner band 49 and downward along outer vertical face 6*b*. The free end 50 is selectively secured to a keyslot 52 or similar attachment means provided in angle member 34 on the floor deck 26 that is provided in proximity to a respective winch 40, as shown in FIGS. 4 and 6. Alternatively, the keyslot can be formed on either side of angle member 34 in floor deck 26 as seen in phantom in FIG. 6. The free end of strap or cable 44 may have a retained hook element 44*a* for ease of securement to a keyslot (FIG. 7).

When not retained, it should be apparent that each cable or strap 44 is retained by upper pulley 48 in a manner that its lower end portion, including free end 50, does not dangle over the side of the flat car 6 when the free end 50 is not secured. After a load of lumber or other lading is placed on the flat car 4, the free end 50 may be readily attached by personnel without climbing above the load 6 as required in the prior art. Following attachment of the free end 50, the respective winches 40, which are proximate to the keyslots 52, can be readily tightened to remove slack. Similarly, the free ends 50 are easily accessible for release by personnel at the lower portion of the flat car 2 after tension on cables or straps 44 is removed through winches 40, such as when unloading. It should also be apparent that the cable/strap assembly 2 is routed around approximately the entire load, including front and back faces, for enhanced securement in comparison to present techniques.

What is claimed is:

1. A center beam/center partition flat railcar comprising body means including a longitudinal center sill and a plurality of side sill assemblies lying in parallel relationship on opposite sides of said center sill, said body means further having an upper beam assembly supported on vertical members arranged above said center sill, floor means arranged adjacent said center sill and said plurality of side sill assemblies for carrying the lading on both sides of said upper beam assembly, a plurality of tensioning means mounted along each side sill assembly, a plurality of elongated members being respectively retained at one end portion to a respective one of said plurality of tensioning means and having a free end, and securement means positioned substantially adjacent said tensioning means for selectively retaining said free end of a respective one of said elongated members at a position adjacent to said tensioning means, said plurality of elongated members being arranged to extend below, upward along a first side, over the top and downward along a second side of the lading being carried by said floor means, said free end being removeably retained by said securement means when the plurality of elongated members are extended over the top and along the second side of the lading.

2. The railcar of claim 1 wherein the lading is in the form of modules supported on opposite sides of said vertical members by said floor means.

3. The railcar of claim 2 wherein said elongated members are routed from said tensioning means under the load upward adjacent an interior face of the lading, over the top of the lading and downward adjacent an outer face of the lading for retention on said securement means.

4. The railcar of claim 3 further comprising means affixed to said body for retaining said elongated members at spaced positions adjacent said floor means and adjacent the top of said interior face 5. The railcar of claim 4 wherein said means for retaining said elongated members are a pair of pulleys secured to said body and engaging spaced intermediate portions of each of said elongated members.

6. The railcar of claim 4 wherein said elongated members are a plurality of cables.

7. The railcar of claim 4 wherein said elongated members are a plurality of straps.

8. The railcar of claim 1 wherein said securement means includes a plurality of keyslots formed in said floor means adjacent each said tensioning means.

9. The railcar of claim 1 wherein said tensioning means includes a plurality of winches affixed along said plurality of side sill assemblies, said securement means being a plurality of retention elements positioned respectively adjacent said plurality of winches.

10. A method of retaining a load positioned on the deck of a center beam/center partition flat car comprising the steps of affixing the end portions of a plurality of cables or straps to adjustable tensioning devices affixed at spaced locations along each side at a lower position on the flat car, positioning the cables or straps beneath the floor deck and upward adjacent the center beam/center partition of the flat car, placing the load on the flat car, extending said cables or straps from an upper portion of the center beam/center partition to be oriented above the load to be carried, guiding the free ends of the cables downward from above the load to a position adjacent the lower position of said tensioning devices, and retaining the free ends of the cables or straps to the flat car adjacent said lower position after a load is placed on the flat car.

11. The method according to claim 10 further comprising the steps of securing an intermediate portion of said cables or straps at a position above the load to be placed on the flat car.

12. The method according to claim 11 further comprising the step of securing another intermediate portion of said cables or straps at a position beneath said load near the longitudinal center line of the flat car.

* * * * *